US006940460B2

(12) United States Patent
Maoz et al.

(10) Patent No.: US 6,940,460 B2
(45) Date of Patent: Sep. 6, 2005

(54) APPARATUS AND METHOD FOR ENHANCING LOW-FREQUENCY OPERATION OF MOBILE COMMUNICATION ANTENNAS

(75) Inventors: Joseph Maoz, Tel Aviv (IL); Michael Kadichevitz, Tel Aviv (IL)

(73) Assignee: In4Tel Ltd., Herzlia Pituah (IL)

( * ) Notice: Subject to any disclaimer, the term of this patent is extended or adjusted under 35 U.S.C. 154(b) by 206 days.

(21) Appl. No.: 10/362,219

(22) PCT Filed: Aug. 16, 2001

(86) PCT No.: PCT/IL01/00767

§ 371 (c)(1),
(2), (4) Date: Feb. 27, 2003

(87) PCT Pub. No.: WO02/19671

PCT Pub. Date: Mar. 7, 2002

(65) Prior Publication Data

US 2004/0125029 A1 Jul. 1, 2004

Related U.S. Application Data

(60) Provisional application No. 60/228,123, filed on Aug. 28, 2000.

(51) Int. Cl.[7] ..... H01Q 1/24; H01Q 1/48

(52) U.S. Cl. ..... 343/702; 343/846

(58) Field of Search ..... 343/702, 745, 343/746, 749, 755, 767, 846

(56) References Cited

U.S. PATENT DOCUMENTS

| | | | | |
|---|---|---|---|---|
| 4,471,493 A | | 9/1984 | Schober | |
| 4,868,576 A | | 9/1989 | Johnson, Jr. | |
| 5,068,670 A | | 11/1991 | Maoz | |
| 5,313,211 A | | 5/1994 | Tokuda et al. | |
| 5,337,061 A | | 8/1994 | Pye et al. | |
| 5,550,554 A | * | 8/1996 | Erkocevic | 343/828 |
| 5,802,458 A | | 9/1998 | Van Zeijl et al. | |
| 5,821,902 A | | 10/1998 | Keen | |
| 5,884,199 A | | 3/1999 | Maki | |
| 5,929,813 A | | 7/1999 | Eggleston | |
| 5,945,954 A | | 8/1999 | Johnson | |
| 6,002,367 A | | 12/1999 | Engblom et al. | |
| 6,016,126 A | | 1/2000 | Holshouser | |
| 6,025,802 A | | 2/2000 | Eggleston et al. | |
| 6,031,503 A | | 2/2000 | Preiss, II et al. | |
| 6,054,954 A | | 4/2000 | Eggleston et al. | |
| 6,072,434 A | | 6/2000 | Papatheodorou | |
| 6,133,879 A | | 10/2000 | Grangeat et al. | |
| 6,133,883 A | | 10/2000 | Munson et al. | |
| 6,218,990 B1 | | 4/2001 | Grangeat et al. | |
| 6,225,958 B1 | | 5/2001 | Amano et al. | |
| 6,252,552 B1 | | 6/2001 | Tarvas et al. | |
| 6,266,538 B1 | | 7/2001 | Waldron | |
| 6,297,776 B1 | * | 10/2001 | Pankinaho | 343/700 MS |
| 6,329,949 B1 | | 12/2001 | Barnett et al. | |
| 6,373,442 B1 | * | 4/2002 | Thomas et al. | 343/767 |
| 6,421,016 B1 | | 7/2002 | Phillips et al. | |
| 6,452,553 B1 | * | 9/2002 | Cohen | 343/702 |

* cited by examiner

*Primary Examiner*—James Vannucci
*Assistant Examiner*—Minh Dieu A
(74) *Attorney, Agent, or Firm*—G. E. Ehrlich (1995) Ltd.

(57) ABSTRACT

The operation of a mobile communication apparatus is enhanced particularly in the lower frequency portion of its bandwidth by connecting an electrically-conductive ground-enlarger to the electrically-conductive ground of the printed wired board (PWB) containing the communication circuitry such that the ground-enlarger effectively enlarges the ground of the PWB to load the antenna in the lower portion of its radio frequency band. The ground-enlarger may include stub ground-enlarger integrally formed on the PWB, or connected thereto, preferably at the end of the PWB opposite to that connected to the antenna. The antenna may be an internal antenna or an external antenna.

33 Claims, 10 Drawing Sheets

APPARATUS AND METHOD FOR ENHANCING LOW-FREQUENCY OPERATION OF MOBILE COMMUNICATION ANTENNAS

This application claims the benefit of Provisional Application No. 60/228,123, filed Aug. 28, 2000.

RELATED PATENT APPLICATION

This application is a National Phase Application of PCT/IL01/00767 International Filing Date 16 Aug. 2001, International Publication No. WO 02/19671, International Publication Date 7 Mar. 2002.

FIELD AND BACKGROUND OF THE INVENTION

The present invention relates to apparatus, and also to a method, for enhancing the operation of mobile communication antennas particularly in the low-frequency portion of the bandwidth or bandwidths for which the apparatus was designed. The invention is particularly useful in mobile communication apparatus (such as mobile telephone handsets) having built-in internal antennas or external antennas, and is therefore described below particularly for such applications.

BACKGROUND OF THE INVENTION

Mobile communication equipment, including their antennas, are becoming smaller in size as the technology is developed. For an antenna to operate properly, it should usually be about half a wavelength in size, except for monopole-like antennas (which normally operate above a ground plane) where a quarter wavelength is required. For advanced mobile communication devices, e.g., cellular telephone handsets, such dimensions are impractical since the overall handset dimensions are smaller than half a wavelength of the appropriate frequency.

Using small antennas therefore reduces their efficiency, and accordingly requires higher power to be supplied. Higher power reduces the intervals between battery recharges, and increases the radiation into the user's head/body. The level of power radiated into the human head is particularly significant, and serious limitations and specifications are prescribed in order to reduce this possible hazard to the users.

Operation of such devices in the vicinity of a human body also changes the field and/or current distribution along the antenna, and hence changes its radiation pattern, as well as the radiation efficiency. Practically speaking, the reduction in efficiency may be in the range of 10–20 dB or more. External whip antennas, such as the "STUBBY" or retractable antennas, are commonly used to increase the antenna efficiency. However, the use of such antennas is also inconvenient as the antennas are often "caught up" inside the pocket. They also detract from the aesthetic appearance of the mobile communication device. Moreover, their radiation pattern is quasi-omni so as to provide little protection of the user's head/body against excessive radiation.

Internal antennas supplied by several companies are relatively inefficient as compared to external antennas. Furthermore, these known internal antennas generally do not decrease the radiation into the user's head/body, and in many cases even increase such radiation. The antenna gain is also generally poor (especially while used adjacent to the head/body), and the SAR (Specific Absorption Ratio) results are generally high.

A particular problem in the known internal antennas is their narrow bandwidth of operation. In addition, where the input impedance is unmatched, the radiation efficiency is even further reduced. The latter is considered an even more difficult problem in cases where dual-frequency bands, triple-frequency bands, or other multi-band operations of the mobile communication devices are required, such as cellular GSM 900/1800, 900/1900, 900/1800/1900 MHz, etc., or in GPRS (2.5G) and UMTS (3G) applications where bandwidth is the key for operation. Further, bandwidth is generally important for all mobile communication applications, in order to maximize the overall system capacity.

Internal antennas for mobile communication apparatus are known that utilize printed constructions, e.g. patches and slots. These are very convenient to use because of their ease of manufacture, their low profile, and their low production cost. Examples of known internal antenna constructions are described in U.S. Pat. Nos. 5,068,670, 5,929,813, 5,945,954, 6,002,367, and 6,025,802, and in European Patent EP 0924797. If such printed elements could be used in mobile communication devices with respect to efficiency, gain, impedance matching and reproducibility, it would be the best choice. Unfortunately, such elements, because of the small size of the mobile communication device, show very low efficiency and hence low gain; moreover it is difficult to match their impedance to that of the mobile communication device.

The present invention is particularly directed to mobile communication apparatus which includes a housing containing a printed circuit board, or PCB (now more commonly referred to as a printed wired board or PWB, which term will be hereafter used) carrying the communication circuitry and formed with a signal terminal and an electrically-conductive ground for the communication circuitry. Such apparatus further includes an antenna carried internally within the housing, or externally of the housing, and electrically-connected to the signal terminal, and optionally also to the ground of the communication circuitry on the PWB within the housing. While such antennas may be designed in a relatively small and compact form for relatively high radio frequency bands, their operation at low radio frequency bands is relatively inefficient. Where the antenna is very small, the printed wired board (PWB) carrying the communication circuitry of the mobile communication apparatus actually serves as an extension of the antenna, and enhances its efficiency and bandwidth. However, since mobile communication devices are becoming smaller in size, this contribution of the PWB to the antenna performance is limited. This limitation applies to all kinds of antennas used with such mobile communication apparatus, i.e., internal antennas as well as external antennas.

OBJECTS AND BRIEF SUMMARY OF THE INVENTION

An object of the present invention is to provide mobile communication apparatus including small, compact antennas, wherein the operating efficiency and bandwidth of the antenna are enhanced. Another object of the invention is to provide a method of enhancing the operating efficiency of such antennas.

According to one aspect of the present invention, there is provided mobile communication apparatus, comprising: a housing including communication circuitry and a printed wired board (PWB) formed with a signal terminal for an antenna, and an electrically-conductive ground for the communication circuitry; an antenna carried by the housing and electrically connected to the signal terminal of the communication circuitry in the PWB (and optionally to the ground), the antenna being designed to operate in at least one radio frequency band; and an electrically-conductive ground-enlarger carried the PWB and electrically connected to the electrically-conductive ground of the PWB such that the electrically-conductive ground-enlarger effectively enlarges the ground of the PWB to load the antenna in said radio frequency band and thereby to enhance the operating efficiency of the antenna particularly in the lower part of said radio frequency band and/or to widen said radio frequency band.

Many embodiments of the invention are described below for purposes of example.

According to further features in the described preferred embodiments, the antenna is connected to the signal terminal of communication circuitry at one end of the PWB, and the electrically-conductive ground-enlarger is connected to the ground of the communication circuitry at the opposite end of the PWB. The ground-enlarger may be carried on a separate board from the PWB and electrically connected to the ground of he communication circuitry at the opposite end of the PWB. Since the electrically-conductive ground-enlarger may be added without enlarging the physical size of the PWB, this enhancement of the operation, and/or widening of the bandwidth, of the mobile communication apparatus can be effected without any significant increase in the physical size of the overall apparatus.

According to further features in some of the described preferred embodiments, the ground-enlarger includes a pair of stub ground-enlarger s formed in the electrically-conductive ground of the PWB at the opposite end of the PWB. In some described preferred embodiments, the opposite end of the PWB includes an electrically-conductive ground on one layer of the PWB, the stub ground-enlarger s being defined by slots formed in the electrically-conductive ground on the one layer. The stub ground-enlargers may be symmetrical or asymmetrical and may have open or shorted ends, according to the particular application.

A further embodiment is described wherein the ground of the communication circuitry is carried on one layer of the PWB, and the ground-enlarger is carried on another layer of the PWB.

According to another preferred embodiment described below, the electrically-conductive ground-enlarger is included in a box having a plurality, e.g., six, sides overlying one end of the PWB, at least one of the sides of the box being electrically-conductive and serving as the ground-enlarger electrically connected to the ground of the PWB.

According to another aspect of the present invention, there is provided a method of enhancing the operational efficiency of a mobile communication apparatus in at least one radio frequency band, or to widen its radio frequency band, which apparatus comprises a housing including communication circuitry and a printed wired board (PWB) formed with a signal terminal for an antenna and an electrically-conductive ground for the communication circuitry, and an antenna carried by the housing and electrically connected to the signal terminal of the communication circuitry in the PWB; characterized in that the operating efficiency of the antenna is enhanced, particularly in the lower portion of the radio frequency band or its radio frequency band is widened by connecting an electrically-conductive ground-enlarger to the electrically-conductive ground of the PWB such that the electrically-conductive ground-enlarger effectively enlarges the ground of the PWB to load the antenna in the radio frequency band.

In case of two or more operational frequency bands, the performance enhancement (i.e., the antenna gain) would practically be applied to the lower band. That is, the higher frequency bands (e.g., 1800 or 1900 MHz) do not always need this extension for normal operation, and only the lower bands (e.g., 800 or 900 MHz) will be enhanced. However, the addition of the ground-enlarger or the stub-ground-enlargers may also enhance the bandwidth of all the operation bands in that it also adjusts the antenna operational frequency down to the required lower frequency band.

As indicated earlier, the apparatus and method of the present invention are applicable to both internal antennas as well as to external antennas.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
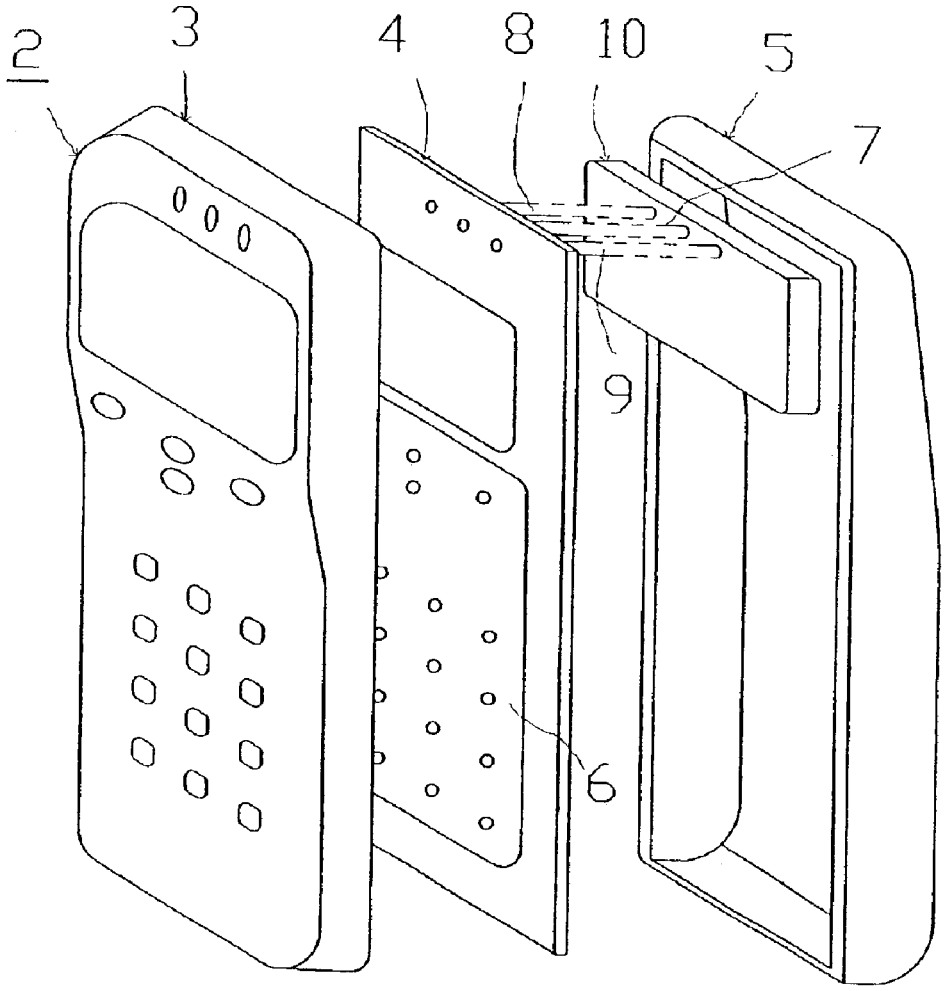
FIG. 1 is an exploded view illustrating one form of mobile communication apparatus constructed in accordance with the present invention.

With reference first to FIG. 1, there is illustrated one form of mobile communication apparatus constructed in accordance with the present invention, including a housing, generally designated 2, constituted of a front cover 3 and a back cover 5. Within housing 2 is a printed wired board (PWB) 4, sometimes referred to as a printed circuit board (PCB), which includes all or a part of the communication circuitry, generally designated 6, of the apparatus. PWB 4 is formed with a signal terminal indicated at 7, and with an electrically-conductive ground connected to ground terminals 8, 9 for the communication circuitry. The ground may be a continuous conductive layer serving as a ground plane, or may be one or more conductive strips serving as a ground for individual components of the communication circuitry.

Figure 2:
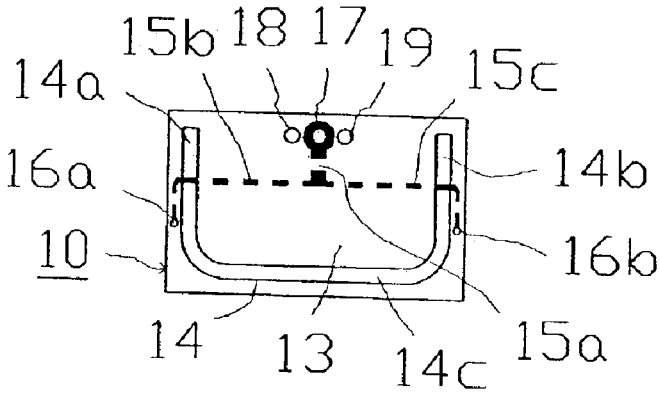
FIG. 2 illustrates an example of an internal antenna which may be used in the apparatus of FIG. 1.

In the apparatus illustrated in FIG. 1, terminals 7–9 are on the underlying surface of PWB 4 and face an internal antenna, generally designated 10, covering a portion of the PWB 4. The internal antenna 10 may be of any desired construction. FIG. 2 illustrates one construction, for purposes of example, which is similar to one of those described in our International Patent Application PCT IL/01/00626 filed 9 Jul. 2001.

Thus, as more particularly shown in FIG. 2, internal antenna 10 includes a PWB constituted of a dielectric substrate having an electrically-conductive layer 13 on one face, serving as the ground plane and cut with a radiant slot 14. Slot 14 is of a curved U-shaped configuration, closed at both of its ends, to define two closed side arms 14*a*, 14*b* joined by a bridge 14*c*. Radiant slot 14 is excited by an electrically-conductive feed line 15 carried on the opposite face of the dielectric panel and therefore indicated by broken lines in FIG. 2.

The antenna illustrated in FIG. 2 is of a symmetrical construction, wherein the two side arms 14*a*, 14*b* are substantially parallel and of substantially the same length and width, and are excited by common excitation point, namely the point where the feed line 15 crosses the slot 14.

The illustrated antenna has a signal input terminal 17 electrically connected to the signal terminal 7 of the PWB 4 (FIG. 1), and two ground terminals 18, 19, electrically connected to the two ground terminals 8, 9 of the PWB 4. These electrical connections may be by pins passing through plated-through-holes (PTHs) or the like. The feed line 15 (shown in broken lines in FIG. 2 since it is on the opposite face of the antenna panel 10) includes a main feed line arm 15*a* connected to the input signal terminal 17. Feed line arm 15*a* divides the power into two feed line transformer sections 15*b*, 15*c*, exciting the slot 14 at two points. The transformer sections 15*b* and 15*c* continue from the excitation points underneath the slot and perform the function of reactive loads which are shorted to the ground 13, as shown at 16*a*, 16*b*. These reactive loads enhance and improve the matching of the slot impedance; that is, they mainly reduce the reactive part of the slot impedance to the order of zero at a broad frequency range.

Further features of the construction and operation of the internal antenna 10 illustrated in FIGS. 1 and 2, as well as alternative constructions that may be used, are described in the above-cited PCT Application PCT/L01/00626, filed 9 Jul. 2001, the contents of which are hereby incorporated by reference.

In the above-cite PCT Application, the antenna is made resonant and radiant not only at a predetermined high frequency, as determined by the parameters of slot 14, the feed line 15, and the reactive loads, but also at a lower frequency band so as to be capable of use as multi-band microwave antenna. In the above-cite PCT Application, this is done by providing an extension in the form of stub ground-enlargers, or by providing a further panel serving as a continuation of the ground plane 13 at the load side of the slot 14, and thereby effectively enlarging the ground plane to load the antenna in a lower radio frequency band, such as to enhance the operating efficiency of the antenna in the lower radio frequency band.

In the present application, a similar technique is used but with respect to the main PWB 4 of the handset 2. This is done by extending the electrically-conductive ground of the printed wired board (PWB) 4 containing the communication circuitry 6, either with an external panel or with stub-ground-enlarger s electrically connected to that ground, so as to effectively enlarge that ground. This effectively loads the antenna in the lower radio frequency band, and thereby enhances the operating efficiency of the antenna in the lower radio frequency band and/or widens that band.

Figure 3:
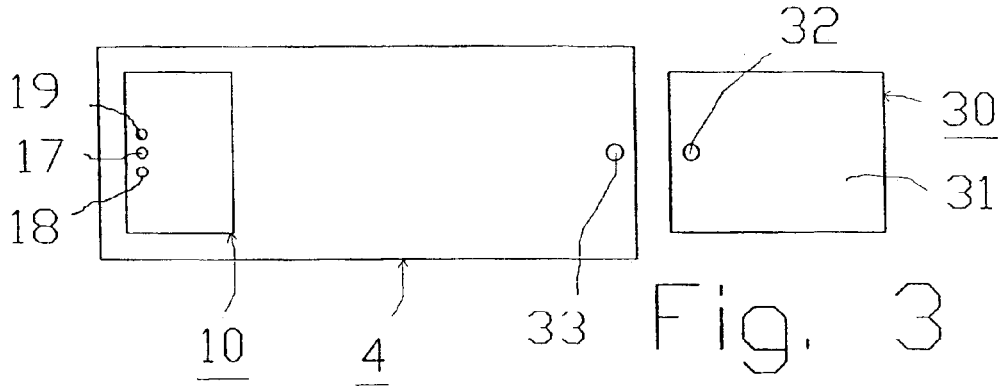
FIG. 3 illustrates one arrangement in accordance with the present invention for enhancing the operating efficiency of the antenna in the apparatus of FIGS. 1 and 2 in the lower radio frequency band, FIGS. 3*a*, 3*b* and 3*c* being side views illustrating possible locations of the ground-enlarger.

FIG. 3 illustrate an arrangement wherein the electrically-conductive ground-enlarger, generally designated 30, is attached to the PWB 4 carrying the internal antenna 10. The ground-enlarger 30 is in the form of an insulating panel carrying an electrical-conductive layer 31 on one face. It is electrically connected by a terminal 32 to a terminal 33 on the PWB 4 at the end of the PWB opposite to that carrying the internal antenna 10 and the signal terminal 7 of the PWB connected to the signal terminal 17 of the internal antenna. The connection between terminals 32 and 33 may be by pin 34 (FIGS. 3*b*, 3*c*); and the connections between the terminals 7–9 of the PWB 4 and terminals 17–19 of the internal antenna 10 may be by pins 35.

Figure 3A:
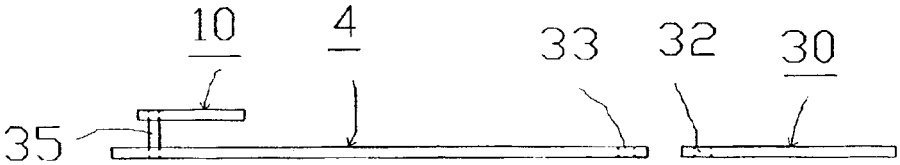
Figure 3B:
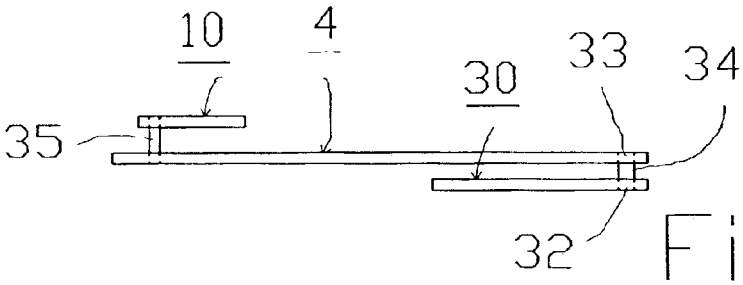
Figure 3C:
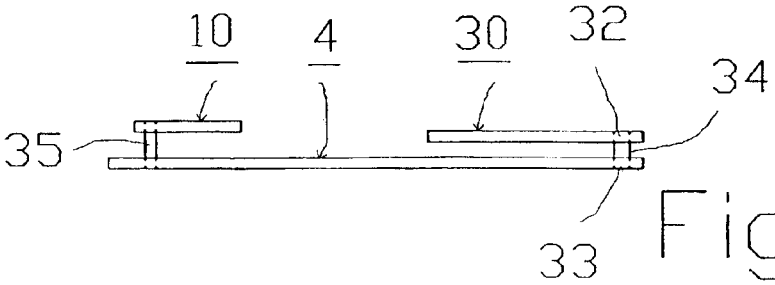

FIG. 3*a*illustrates the initial stage in the preparation of the ground-enlarger 30; FIG. 3*b*illustrates the application of the ground-enlarger to underlie the respective end of the PWB 4; and FIG. 3*c* illustrates the application of the ground-enlarger to overlie the respective end of the PWB 4.

It will thus be seen that the ground-enlarger 30 acts as a load to the antenna in the lower operational band, by enlarging the ground plane of the main PWB 4 (and thereby of the antenna 10 ). A described above, this improving antenna matching and enhances the operating efficiency of the antenna in the lower radio frequency band. The dimensions and shape of the ground-enlarger 30, as well as the distance from the PWB 4, may vary. Although the ground-enlarger is shown in FIGS. 3*b*and 3*c* as parallel to the main PWB 4, it may be mounted to the latter at any desired angle. The ground-enlarger may be made in any suitable manner, such as by providing a conductive layer on an insulating board, by using a metal plate, metallic paint, metal plated plastic, etc. It may also be an independent part of the apparatus, such as a part of the battery, the housing cover, the keyboard, etc.

It will also be appreciated that the antenna 10 may also be connected to the ground of the PWB 4, in addition to its connection to the signal terminal 17 of the PWB 4.

Figure 4:
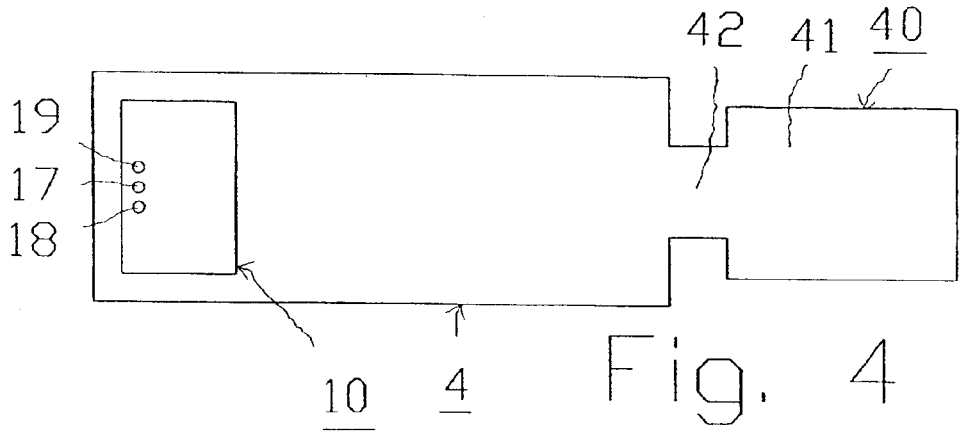
FIGS. 4, 4*a*, 4*b* and 4*c* are views, corresponding to those of FIGS. 3, 3*a*, 3*b* and 3*c*, respectively, illustrating another arrangement in accordance with the present invention for enhancing the operating efficiency of the antenna in the lower radio frequency band.
Figure 4A:
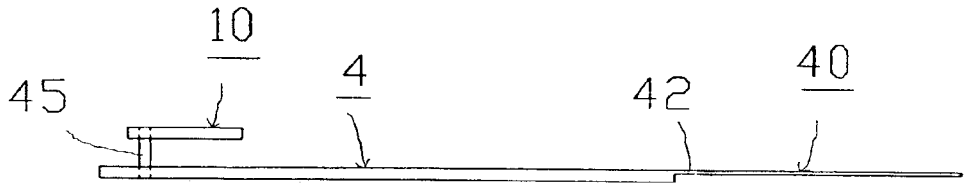
Figure 4B:
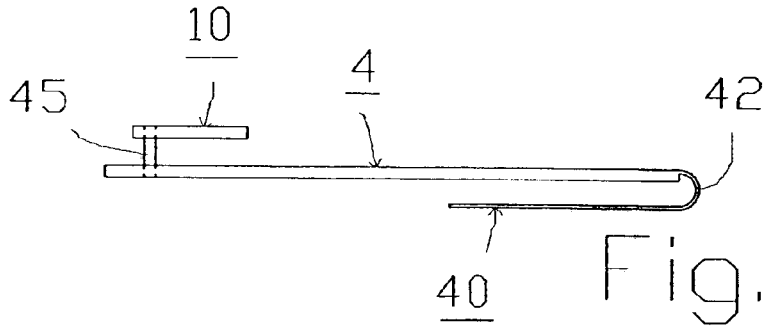
Figure 4C:
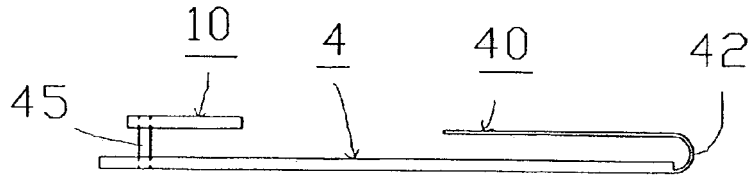

FIG. 4 illustrates ground-enlarger, generally designated 40, constructed as a flexible part of the PWB 4, or of the conductive layer of that board, at the opposite end carrying the internal antenna 10 and the input signal terminals 7 of the PWB 4, and the corresponding terminal 17 of the internal antenna. The ground-enlarger 40 illustrate in FIG. 4 thus also includes an electrically-conductive layer 41 which is connected by a flexible strip 42 to the electrically-conductive layer of the PWB 4. Preferably, the ground-enlarger 40 is bent under the respective end of the PWB 4 (FIG. 4*b*), or over the respective end of the PWB 4 (FIG. 4*c*) or at any angle thereto, to provide a compact arrangement for the PWB 4 which enhances the operating efficiency of the antenna in the lower radio frequency band, as described above. The antenna 10 is connected to the PWB 4 in any suitable manner, such as by pins 45 passing through the signal terminal 17 and ground terminals 18, 19 in the antenna, and the corresponding terminals 7–9 (FIG. 1) in the PWB 4.

Figure 5A:
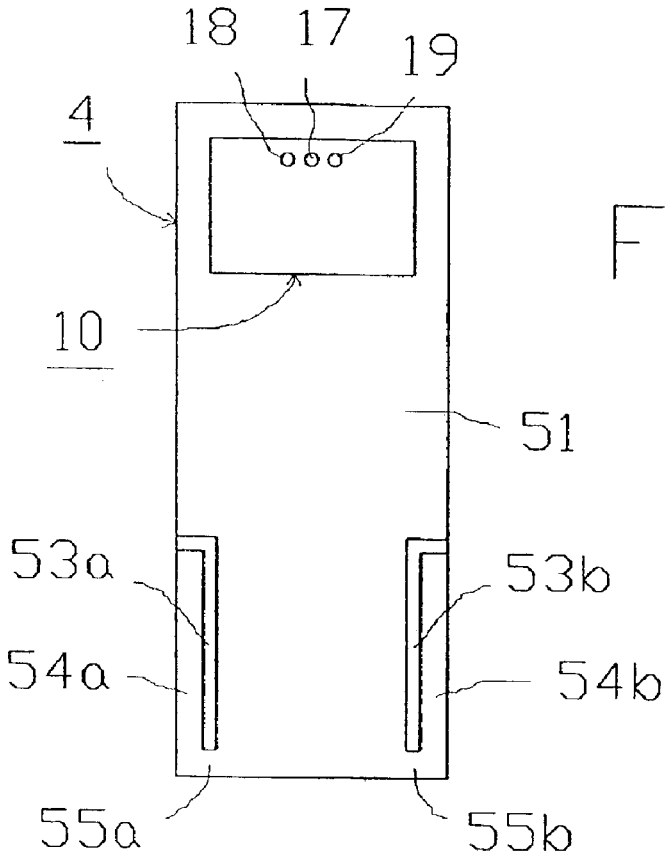
FIGS. 5*a* and 5*b* are views of the opposite faces of the PWB in the apparatus of FIGS. 1 and 2 illustrating a further arrangement in accordance with the present invention for enhancing the operating efficiency of the antenna in the lower radio frequency band.
Figure 5B:
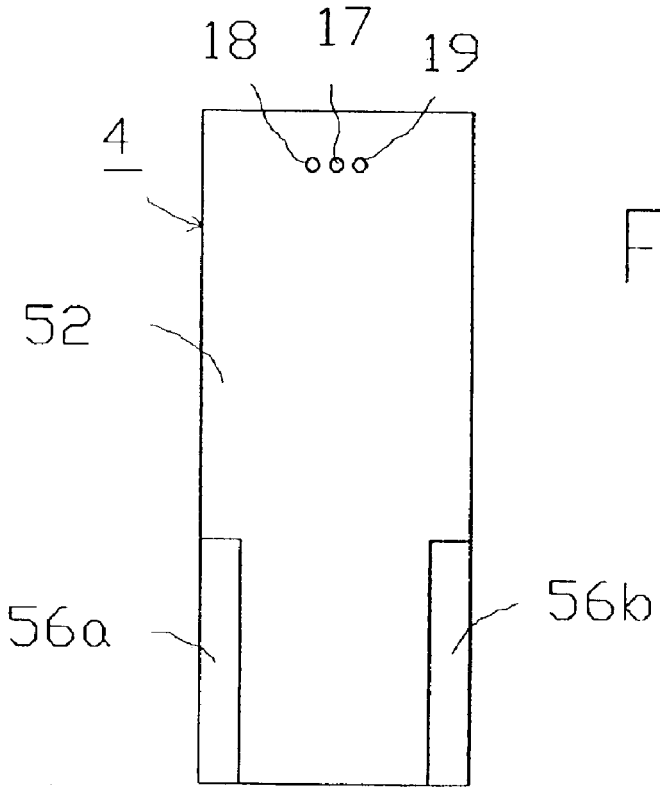

FIGS. 5*a* and 5*b* illustrate a construction wherein the electrically-conductive ground-enlarger is in the form of stub ground-enlarger s formed in the end of the PWB 4 opposite to that carrying the internal antenna 10 and the signal input terminal 17 of the antenna. In this case, the PWB 4 is provided with an electrically-conductive layer on both of its opposite faces, as shown at 51 in FIG. 5*a* and 52 in FIGS. 5*b*. The face 51, shown in FIG. 5*a*, which carries the internal antenna 10, is formed, at the opposite end from that carrying the internal antenna 10, with a pair of slots 53*a*, 53*b*, cut in the conductive layer 51 defining the ground plane. Each of the slots 53*a*, 53*b* is closed at one end and open at the opposite end to define two stub ground-enlarger s 54*a*, 54*b*, and electrical connections 55*a*, 55*b* at the ground plane 51. The electrically-conductive layer 52 on the opposite face of the PWB 4 (as shown in FIG. 5*b*) is formed with two interruptions 56*a*, 56*b* i.e., areas without conductors, in the ground plane 52 in alignment with the stub ground-enlarger s 54*a*, 54*b*.

The stub ground-enlarger s 54*a*, 54*b*, thus act similarly to the ground-enlarger 30 in FIG. 3, to effectively enlarge the ground plane 51 of the PWB 4, but better enable tuning to enhance the operating efficiency of the antenna in the lower radio frequency band.

Figure 6A:
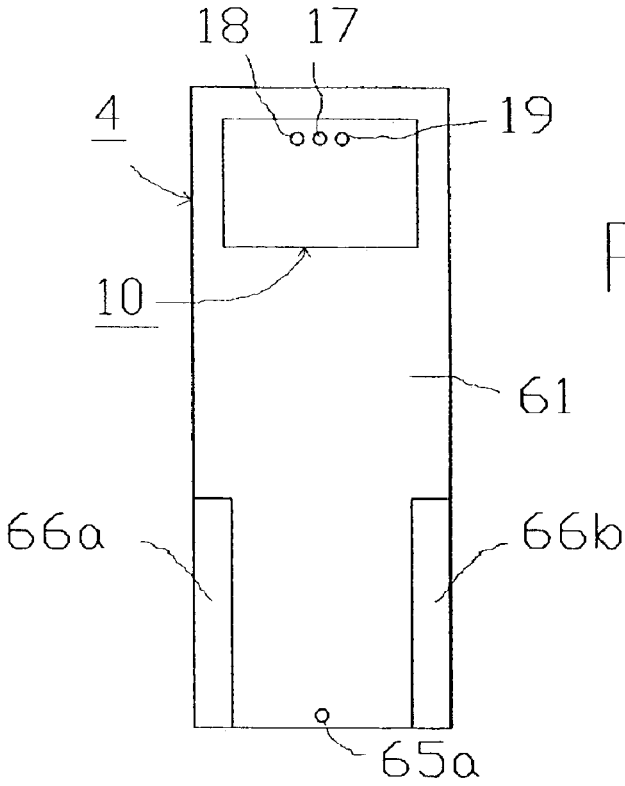
FIGS. 6*a*, 6*b*, 7*a*, 7*b* and 8*a*, 8*b* are views corresponding to those of FIGS. 5*a* and 5*b*, respectively, illustrating three other arrangements that may be used in accordance with the present invention.
Figure 6B:
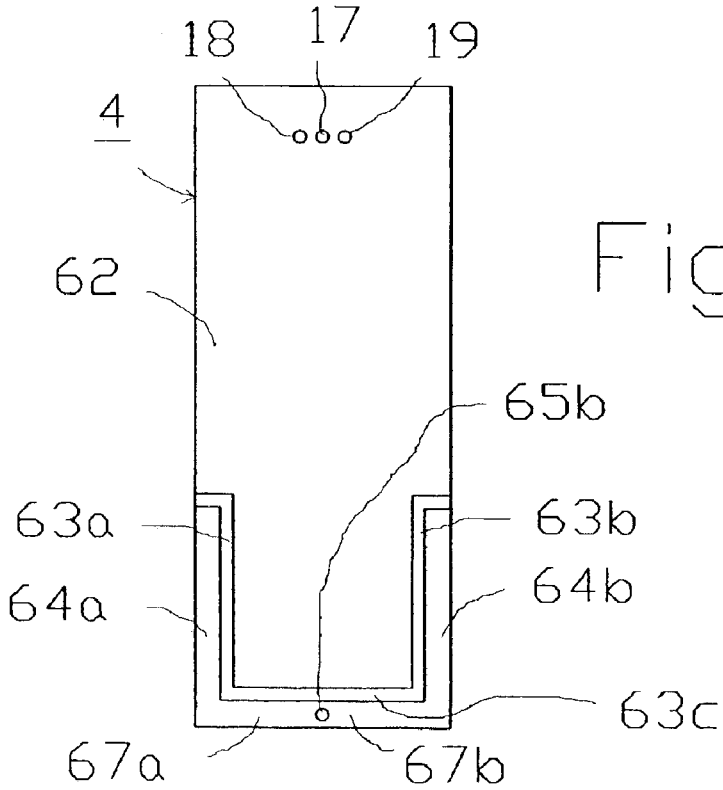

FIGS. 6*a* and 6*b* illustrate a construction similar to that of FIGS. 5*a* and 5*b*, except that the stub ground-enlarger s and the interruptions are reversed with respect to the opposite faces of the PWB 4. Thus, as shown in FIG. 6*a*, the electrically-conductive layer 61 on the side of PWB 4 carrying the internal antenna 10 is formed with the interruptions 66*a*, 66*b*; whereas the opposite face of the PWB 4 carrying the electrically-conductive layer 62 is formed with the slots 63*a*, 63*b*, defining the stub ground-enlarger s 64*a*, 64*b*. The electrical connections for exciting the stub ground-enlarger s 64*a*, 64*b* are in the form of PTHs 65*a*, 65*b*, and the conductive portions 67*a*, 67*b* of layer 62 electrically connecting conductive lager 61 to the stub ground-enlarger s 64*a*, 64*b*; while the slots 63*a*, 63*b* insulate the stub ground-enlarger s from the electrically-conductive layer 62.

Figure 7A:
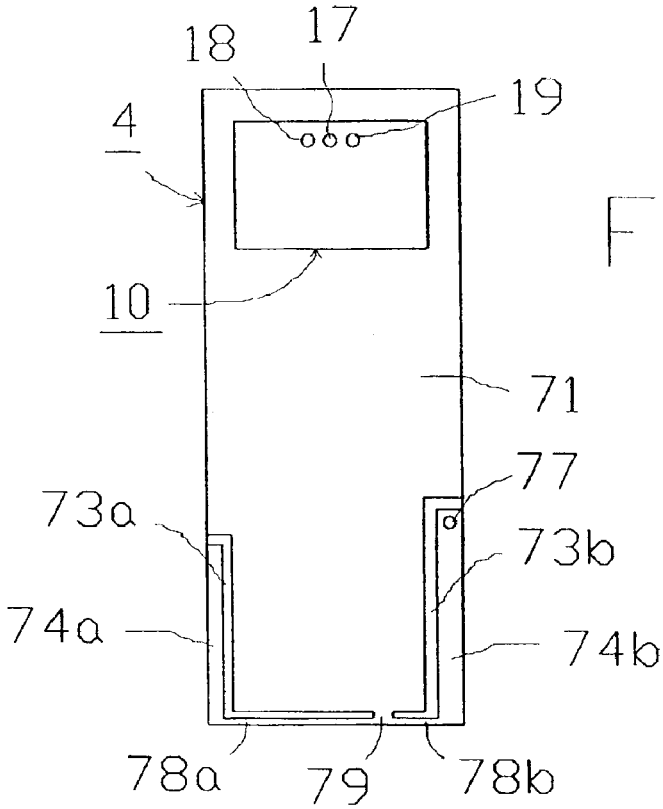
Figure 7B:
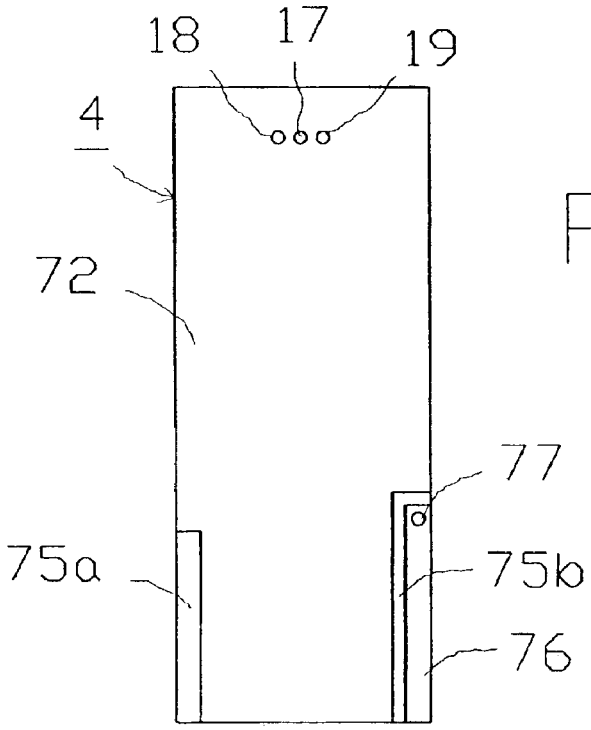

FIGS. 7*a* and 7*b* illustrate an arrangement also similar to that of FIGS. 5*a* and 5*b*, respectively, but wherein the two stub ground-enlarger s are of an asymmetrical construction. Thus, as shown in FIG. 7*a*, the slots 73*a*, 73*b*, are cut in the electrically-conductive layer 71 of the PWB 4 in the form of two half-closed slots of different configurations so to define two stub ground-enlarger s 74*a*, 74*b* of different configurations and electrically connected to the electrically-conductive layer 71 (serving as the ground) by electrical connections 78*a*, 78*b* also of different configurations. Interruption 75*a* in the electrically-conductive layer 72 on the opposite face of the PWB 4 is of a rectangular configuration, whereas interruption 75*b* is of an L-shaped configuration such as to define a ground-enlarger extension 76 on face 72 (FIG. 7*b*). Ground-enlarger extension 76 is electrically connected by a plated-through-hole 77 (or pin, etc) to the stub ground-enlarger 74*b* on the opposite face of the PWB 4. The electrical connections 78*a*, 78*b* to the stub ground-enlarger s are separated by gap 79 in the two slots 73*a*, 73*b*.

By controlling the location, width and length of the gap 79, and the width and length of each stub ground-enlarger 74*a*, 74*b*, each half open slot 73*a*, 73*b*, each electrical connection 78*a*, 78*b*, the ground interruption 75*a*, the ground-enlarger extension 76 and the slot 75*b*, the main PWB 4 can be separately tuned to enhance the antenna operation in two low frequency bands.

While the stub ground-enlarger 74*a* and the ground-enlarger extension 76 shown are open ended, it is appreciated that each of them can also be grounded at its end.

Figure 8A:
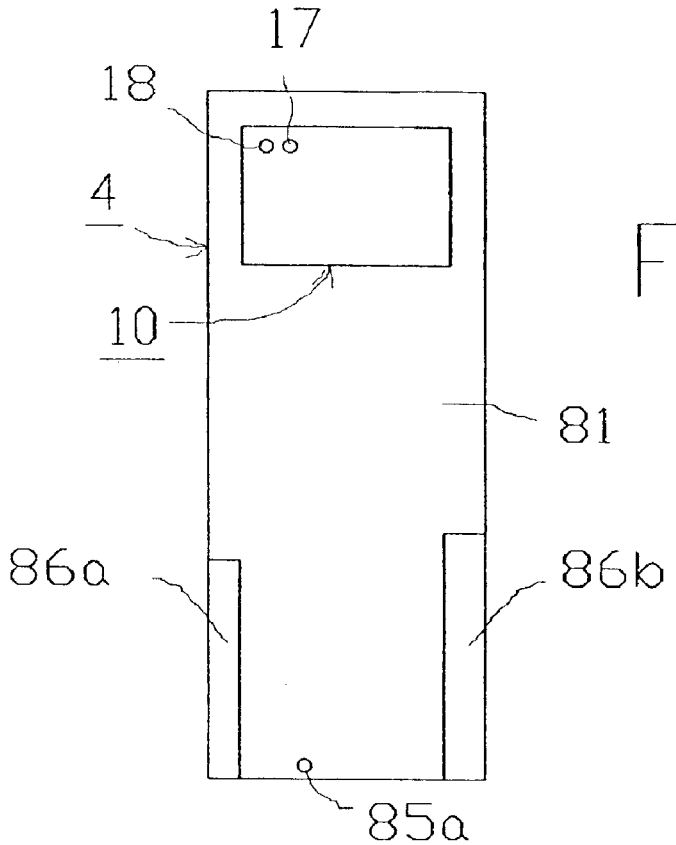
Figure 8B:
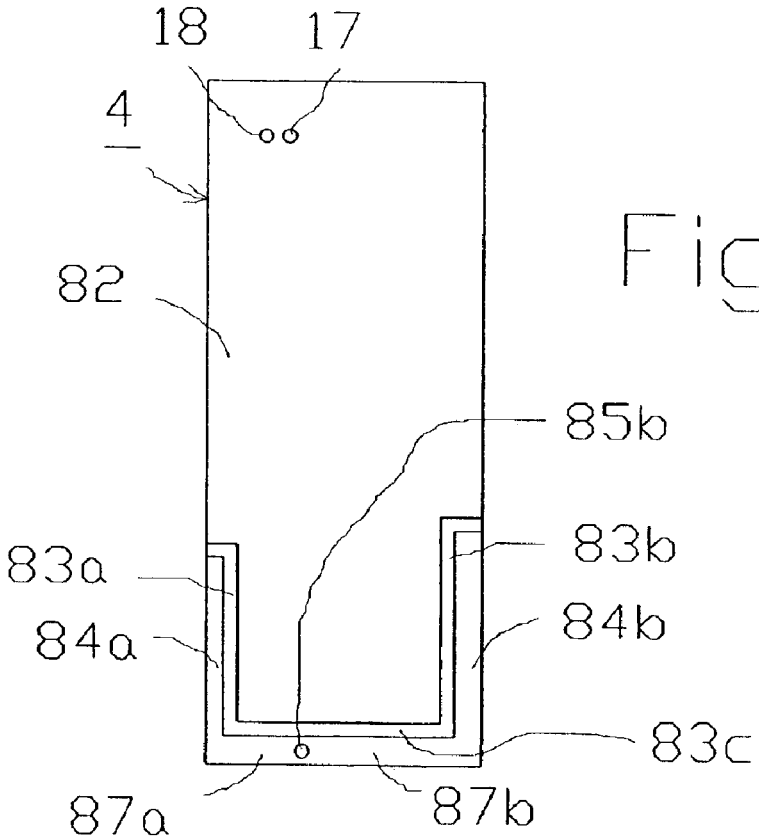

FIGS. 8*a* and 8*b* illustrate a construction similar to that of FIGS. 6*a* and 6*b*, except that the stub ground-enlarger s are asymmetrical, and the connections of the antenna 10 to the PWB 4 are by means of two terminals rather than three terminals. Thus, the internal antenna 10 carried by the PWB 4 includes a signal input terminal 17, but only a ground terminal 18 on one side of the latter terminal. The location of the terminal 18 can be changed as desired. In addition, the interruptions 86*a*, 86*b* formed in the conductive layer 81 on one side of the PWB 4, and the slots 83*a*, 83*b*, formed in the electrically-conductive layer 82 on the opposite face of the PWB are the same as the corresponding interruptions 66*a*, 66*b* and slots 63*a*, 63*b* in FIGS. 6*a*, 6*b*, except that they are asymmetrical. The electrical connections for exciting the stub ground-enlarger s 84*a*, 84*b* in the form of PTH 85*a*, 85*b* or the like, the electrical connections 87*a*, 87*b* electrically connecting conductive layer 81 to the stub ground-enlarger s are asymmetrical as well.

Other constructions for stub ground-enlarger s could be used. For example, the stub ground-enlarger s could be in the form of, or could include, discrete reactive elements, such as described in U.S. Pat. No. 5,068,670.

Figure 9:
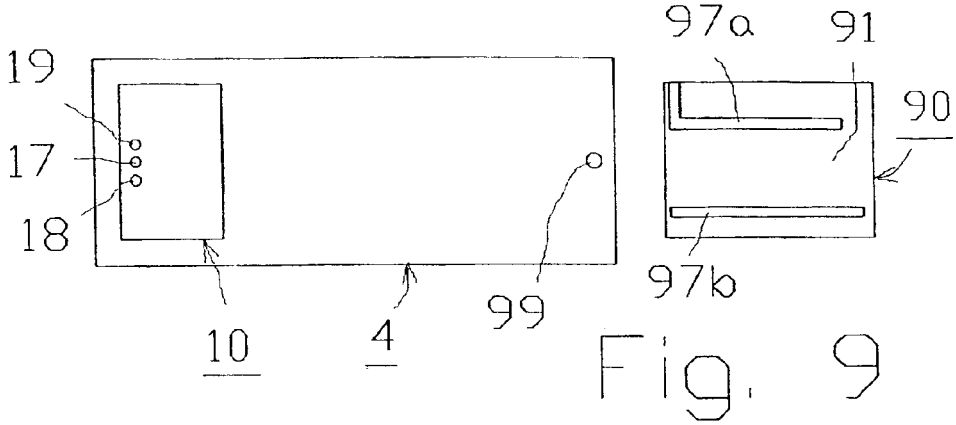
FIG. 9 illustrates a still further arrangement wherein the electrically-conductive ground-enlarger is in the form of a box having one or more electrically-conductive faces, FIG. 9*a* illustrating one example of such a box construction, and FIGS. 9*b* and 9*c* illustrating alternative dispositions of the box with respect to the PWB.
Figure 9A:
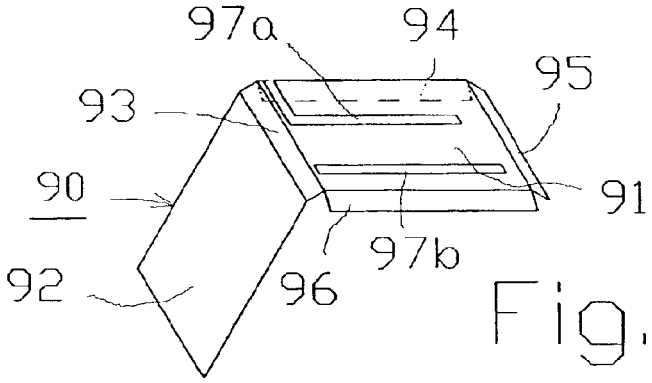

FIG. 9 illustrate a construction wherein the electrically-conductive ground-enlarger, therein designated 90, is in the form of a plural-sided, i.e., six-sided box to be carried by the end of the PWB 4 opposite to that carrying the internal antenna 10 and the signal input terminal 17 of that ground-enlarger. The six sides of box ground-enlarger 90 are shown at 91–96, respectively, in FIG. 9*a*. Side 91 includes an electrically-conductive layer formed with an open slot 97*a*, and a closed slot 97*b*. Side 93 is made completely electrically-conductive, whereas the remaining sides 92, 94, 95 and 96 are electrically insulating.

Figure 9B:
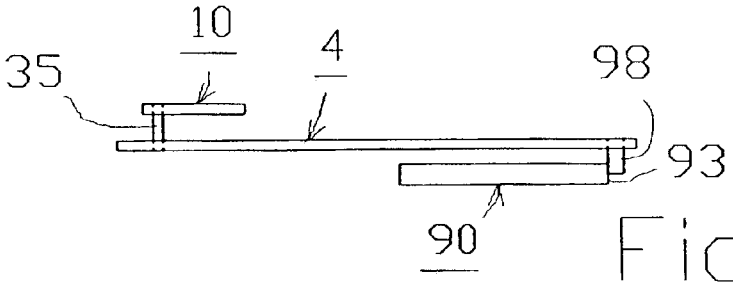
Figure 9C:
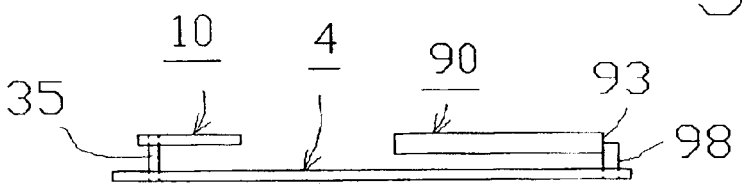

The ground-enlarger box 90 may be mounted below the PWB 4 (FIG. 9*b*) or above (FIG. 9*c*). In either case, its electrically-conductive layers (91, 93) are electrically connected to the electrically-conductive layer of the PWB 4 in any suitable manner, e.g., as by a spring-loaded conductive pin 98 passing through a plated-through-hole 99 in the PWB 4 and engaging electrically-conductive side 93.

As described above, the purpose of the electrically-conductive layers of the ground-enlarger 90 is to effectively enlarger the ground plane of the PWB 4 so as to load the antenna 10 in the lower radio frequency band, and thereby to enhance the operating efficiency of the antenna in the lower radio frequency band. The ground-enlarger box 90 may therefore have a different number or arrangement of electrically-conductive layers for effectively enlarging the ground of the PWB 4. Similarly, the slots 97*a*, 97*b* may be of different locations and/or configurations to improve the matching, and thereby to enhance the radiation of the antenna in the desired operational band. In some cases, only one slot, or no slots, may be provided.

In all the above-described embodiments of the invention, the antenna is an internal antenna. It will be appreciated, however, that the invention could also be implemented in mobile communication apparatus having external antennas.

Figure 10:
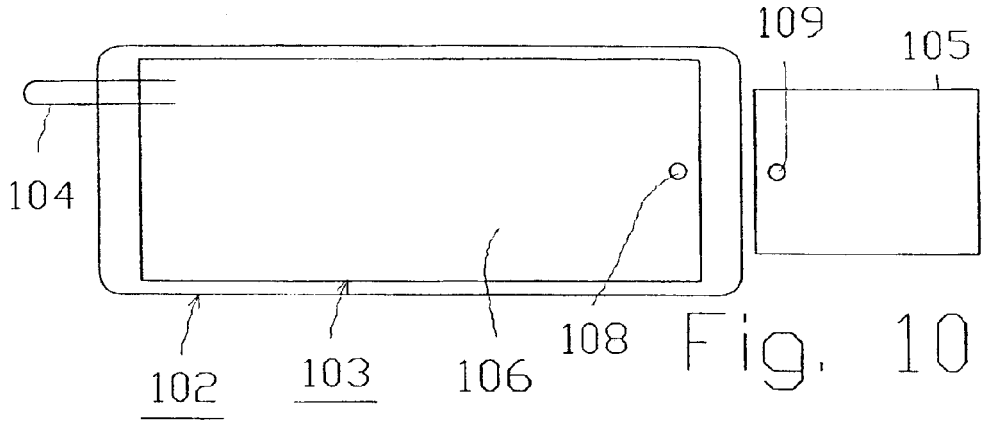
FIGS. 10, 10*a*, 10*b*, and 10*c* are views, corresponding to those of FIGS. 3, 3*a*, 3*b* and 3*c*, respectively, illustrating an arrangement similar to that of FIG. 3 but wherein the antenna is an external antenna, rather than an internal antenna.
Figure 10A:
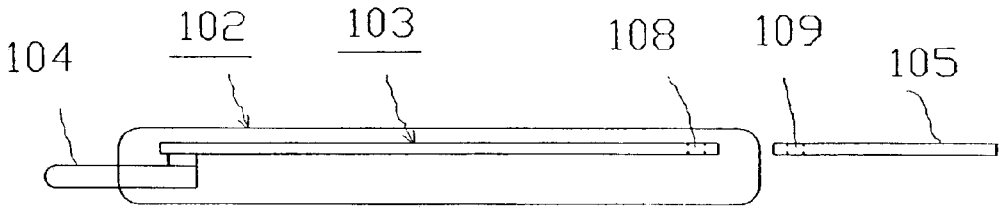
Figure 10B:
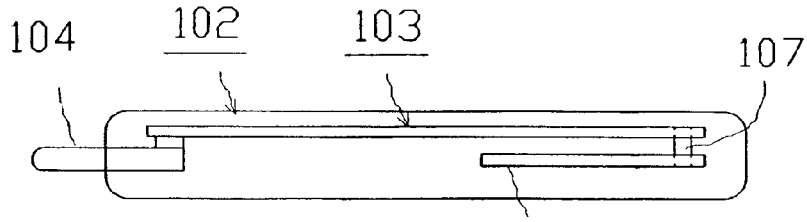
Figure 10C:
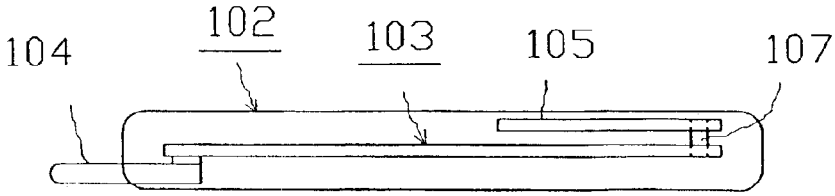

One such construction is illustrated in FIG. 10, wherein the housing is shown at 102, the PWB containing the communication circuitry of the apparatus is shown at 103, and the external antenna is shown at 104. The electrically-conductive ground-enlarger, shown at 105, for effectively enlarging the ground of the PWB 103 to load the antenna 104 in a lower radio frequency band may be any of the constructions described above. It is electrically connected to the ground conductive layer 106 at the opposite end of the PWB 103 connected to the antenna by a pin 107 passing through PTHs 108, 109 in the PWB and the ground-enlarger, respectively. The ground-enlarger 105 may be mounted to underlie the PWB 103 as shown in FIG. 10*b*, to overlie it as shown in FIG. 10*c*, or at any angle thereto.

Figure 11A:
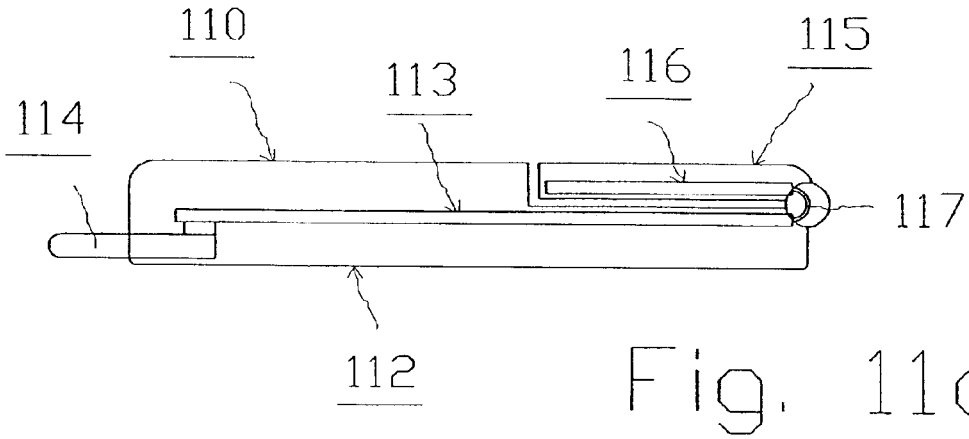
FIGS. 11*a* and 11*b* illustrate the invention implemented in a mobile telephone handset having an external antenna, FIG. 11*a* illustrating the closed position of the handset and FIG. 11*b* illustrating the open position of the handset.
Figure 11B:
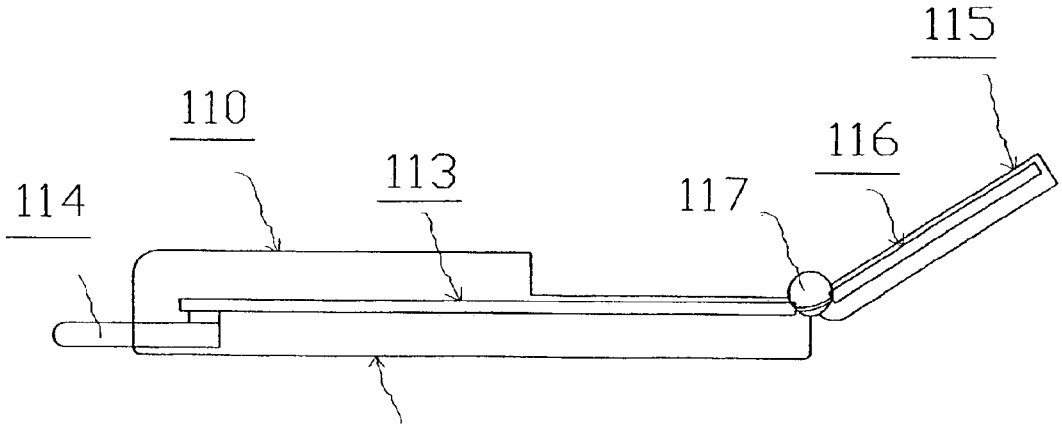

FIGS. 11*a* and 11*b* illustrate another implementation of the invention, in the form of a mobile telephone handset, generally designated 110, including a main housing 112 containing the main PWB 113, an external antenna 114, and a flip section 115 containing the microphone of the handset. In this embodiment of the invention, the ground-enlarger provided to effectively enlarge the ground of the PWB 113 is carried by the flip section 115 as shown at 116. The ground-enlarger 116 is electrically connected to the ground of the PWB 113 at its end opposite to that connected to the external antenna 114 in any suitable manner, e.g., by an electrically-conductive flexible 117 in the pivoted coupling of the flip section 115 to the housing 112.

Other constructions of mobile telephone handsets are known in which the housing has two sections movable relative to each other, (e.g., relatively slidable sections), in which the PWB, communication circuitry and signal terminal are in one section. The invention may also be implemented in those constructions, e.g., by including the electrically-conductive ground-enlarger in the other section.

While the invention has been described with respect to several preferred embodiments, it will be appreciated, therefore, that these are set forth merely for purposes of example, and that many other variations, modifications and applications of the invention may be made.

What is claimed is:

1. Mobile communication apparatus, comprising:

a housing including communication circuitry and a printed wired board (PWB) formed with a signal terminal for an antenna, and an electrically-conductive ground for said communication circuitry;

an antenna carried by said housing and electrically connected to said signal terminal of the communication circuitry in the PWB, said antenna being designed to operate in at least one radio frequency band;

and an electrically-conductive ground-enlarger carried by said PWB and electrically connected to said electrically-conductive ground of the PWB such that said electrically-conductive ground-enlarger effectively enlarges said ground of the PWB to load the antenna in said radio frequency band, and thereby to enhance the operating efficiency of the antenna particularly in the lower part of said radio frequency band, and to widen said radio frequency band.

2. The apparatus according to claim 1, wherein said antenna is connected to the signal terminal of the communication circuitry at one end of the PWB, and said electrically-conductive ground-enlarger is connected to the ground of the communication circuitry at the opposite end of said PWB.

3. The apparatus according to claim 2, wherein said ground-enlarger is carried on a separate board from said PWB and is electrically connected to the ground of the communication circuitry at said opposite end of the PWB.

4. The apparatus according to claim 3, wherein said ground-enlarger board is fixed to said PWB and underlies said opposite end of the PWB.

5. The apparatus according to claim 3, wherein said ground-enlarger board is fixed to said PWB and overlies said opposite end of the PWB.

6. The apparatus according to claim 3, wherein said ground-enlarger board is integrally formed with said PWB at said opposite end thereof, and is folded with respect to said opposite end of the PWB.

7. The apparatus according to claim 1, wherein said ground of the communication circuitry is carried on one layer of said PWB, and said ground-enlarger is carried on another layer of said PWB.

8. The apparatus according to claim 1, wherein said signal terminal of the communication circuitry is on one layer of the PWB at one end thereof, and said ground-enlarger is carried on another layer of the PWB at the opposite end thereof.

9. The apparatus according to claim 1, wherein said ground-enlarger includes at least one stub ground-enlarger carried by said PWB.

10. The apparatus according to claim 1, wherein said signal terminal of the communication circuitry is at one end of the PWB, and said ground-enlarger includes at least one stub ground-enlarger at the opposite end of the PWB.

11. The apparatus according to claim 10, wherein said ground-enlarger includes a pair of stub ground-enlargers formed in the electrically-conductive ground of the PWB at said opposite end of the PWB.

12. The apparatus according to claim 11, wherein said opposite end of the PWB includes an electrically-conductive ground on one layer of the PWB, said stub ground-enlargers being defined by slots formed in the electrically-conductive ground on said one layer.

13. The apparatus according to claim 12, wherein said PWB includes an electrically-conductive ground on a second layer of the PWB, said second layer being formed with interruptions in said electrically-conductive ground, which interruptions are aligned with said stub ground-enlargers in said one layer.

14. The apparatus according to claim 12, wherein said stub ground-enlargers include electrically-conductive portions on another layer of said PWB to which said stub ground-enlargers are electrically connected.

15. The apparatus according to claim 1, wherein said electrically-conductive ground-enlarger is included in a box having a plurality of sides overlying one end of the PWB, at least one of said sides of the box being electrically-conductive and serving as the ground-enlarger electrically connected to said ground of the PWB.

16. The apparatus according to claim 15, wherein a plurality of said sides of said electrically-conductive ground-enlarger box are electrically-conductive and serve as the ground-enlarger electrically connected to said ground of the PWB.

17. The apparatus according to claim 15, wherein said at least one electrically-conductive side of said ground-enlarger box is formed with at least one slot to modify the load produced by said ground-enlarger box.

18. The apparatus according to claim 1, wherein said antenna is an internal antenna within said housing and is electrically connected to said PWB within said housing.

19. The apparatus according to claim 1, wherein said antenna is an external antenna carried by said housing externally thereof and is electrically connected to said PWB within said housing.

20. The apparatus according to claim 1, wherein said antenna is electrically connected to the ground of said PWB, in addition to its connection to the signal terminal of said PWB.

21. The apparatus according to claim 1, wherein said mobile communication apparatus is a mobile telephone handset and includes a housing having two sections movable relative to each other, one of said housing sections including said PWB, communication circuitry, and signal terminal for an antenna, the other of said housing sections including said electrically-conductive ground-enlarger.

22. The apparatus according to claim 21, wherein said other housing section is pivotal with respect to said one housing section.

23. A method of enhancing the operational efficiency of a mobile communication apparatus in at least one radio frequency band, or to widen its radio frequency band, which apparatus comprises a housing including communication circuitry and a printed wired board (PWB) formed with a signal terminal for an antenna and an electrically-conductive ground for said communication circuitry, and an antenna carried by said housing and electrically connected to said signal terminal of the communication circuitry in the PWB;

characterized in that the operating efficiency of the antenna is enhanced, particularly in the lower portion of said radio frequency band, or its radio frequency band is widened by connecting an electrically-conductive ground-enlarger to said electrically-conductive ground of the PWB such that said electrically-conductive ground-enlarger effectively enlarges said ground of the PWB to load the antenna in said radio frequency band.

24. The method according to claim 23, wherein said antenna is connected to the signal terminal of the communication circuitry at one end of the PWB, and said electrically-conductive ground-enlarger is connected to the ground of the communication circuitry at the opposite end of said PWB.

25. The method according to claim 24, wherein said ground-enlarger is carried on a separate board from said PWB and is electrically connected to said opposite end of the PWB.

26. The method according to claim 23, wherein said ground of the communication circuitry is carried on one layer of said PWB, and said ground-enlarger is carried on another layer of said PWB.

27. The method according to claim 23, wherein said signal terminal of the communication circuitry is on one layer of the PWB at one end thereof, and said ground-enlarger is carried on another layer of the PWB at the opposite end thereof.

28. The method according to claim 23, wherein said ground-enlarger includes at least one stub ground-enlarger carried by said PWB.

29. The method according to claim 23, wherein said antenna is an internal antenna within said housing and is electrically connected to said PWB within said housing.

30. The method according to claim 23, wherein said antenna is an external antenna carried by said housing externally thereof and is electrically connected to said PWB within said housing.

31. The method according to claim 23, wherein said antenna is electrically connected to the ground of said PWB, in addition to its connection to the signal terminal of said PWB.

32. The method according to claim 23, wherein said mobile communication apparatus is a mobile telephone handset and includes a housing having two sections movable relative to each other, one of said housing sections including said PWB, communication circuitry, and signal terminal for an antenna, the other of said housing sections including said electrically-conductive ground-enlarger.

33. The method according to claim 23, wherein said electrically-conductive ground-enlarger is formed with slots to modify the load produced thereby.

* * * * *